US012497874B2

(12) United States Patent
Tschauner et al.

(10) Patent No.: US 12,497,874 B2
(45) Date of Patent: Dec. 16, 2025

(54) ELECTRIC SUBMERSIBLE PUMP (ESP) SYSTEM AND METHOD

(71) Applicant: ExxonMobil Technology and Engineering Company, Spring, TX (US)

(72) Inventors: Michael C. Tschauner, Odessa, TX (US); Billy-Bob K. Walker, Midland, TX (US); Michael C. Romer, Tomball, TX (US)

(73) Assignee: ExxonMobil Technology and Engineering Company, Spring, TX (US)

( * ) Notice: Subject to any disclaimer, the term of this patent is extended or adjusted under 35 U.S.C. 154(b) by 161 days.

(21) Appl. No.: 18/423,797

(22) Filed: Jan. 26, 2024

(65) Prior Publication Data

US 2024/0280007 A1 Aug. 22, 2024

Related U.S. Application Data

(60) Provisional application No. 63/486,119, filed on Feb. 21, 2023.

(51) Int. Cl.

| | |
|---|---|
| ***E21B 43/12*** | (2006.01) |
| ***E21B 17/02*** | (2006.01) |
| ***F04B 47/06*** | (2006.01) |
| ***F04D 13/06*** | (2006.01) |
| ***F04D 13/10*** | (2006.01) |

(52) U.S. Cl.
CPC ..... *E21B 43/128* (2013.01); *E21B 17/026* (2013.01); *E21B 17/028* (2013.01); *F04B 47/06* (2013.01); *F04D 13/0693* (2013.01); *F04D 13/10* (2013.01)

(58) Field of Classification Search
CPC .... E21B 43/128; E21B 17/026; E21B 17/028; F04B 47/06; F04D 13/0693; F04D 13/10
See application file for complete search history.

(56) References Cited

U.S. PATENT DOCUMENTS

| | | | | |
|---|---|---|---|---|
| 3,916,685 | A | 11/1975 | Paap et al. | |
| 7,832,503 | B2 | 11/2010 | Sand et al. | |
| 8,322,434 | B2 | 12/2012 | Fielding et al. | |
| 9,121,270 | B2 | 9/2015 | Seitter | |
| 9,388,812 | B2 | 7/2016 | Fastovets et al. | |
| 9,863,204 | B2 * | 1/2018 | Chan | E21B 33/0385 |
| 9,970,250 | B2 * | 5/2018 | Hess | E21B 23/01 |
| 10,132,143 | B2 | 11/2018 | Romer et al. | |

(Continued)

*Primary Examiner* — Charles G Freay
(74) *Attorney, Agent, or Firm* — ExxonMobil Technology and Engineering Company—Law Department

(57) ABSTRACT

An electric submersible pump (ESP) system is described herein. The ESP system includes a pump and a motor connected to drive the pump. The pump and motor are disposed to pump fluid into production tubing in a wellbore. A connector is in fluid communication with the production tubing and the connector contains a receptacle to receive a plug. A fixed power cable section is connected at a first end to power the motor. The fixed power cable section is fixedly connected at a second end to the receptacle of the connector. Also included in the ESP system is an ESP power cable that extends through the production tubing to an ESP surface unit. The ESP power cable includes a removable plug to engage the receptacle of the connector.

23 Claims, 5 Drawing Sheets

(56) References Cited

U.S. PATENT DOCUMENTS

| | | | | |
|---|---|---|---|---|
| 10,224,669 | B1 * | 3/2019 | Tanner | H02K 5/132 |
| 10,480,297 | B2 | 11/2019 | Chidi et al. | |
| 11,365,613 | B2 | 6/2022 | Romer et al. | |
| 11,555,396 | B2 | 1/2023 | Romer et al. | |
| 11,990,705 | B2 * | 5/2024 | Zhong | E21B 17/0285 |
| 2004/0134654 | A1 | 7/2004 | Snow | |
| 2009/0211763 | A1 | 8/2009 | Fowler et al. | |
| 2010/0270032 | A1 * | 10/2010 | Monjure | E21B 33/03 166/381 |
| 2016/0258231 | A1 * | 9/2016 | Naumann | E21B 17/003 |
| 2018/0066479 | A1 * | 3/2018 | Head | E21B 43/128 |

* cited by examiner

200

500

ELECTRIC SUBMERSIBLE PUMP (ESP) SYSTEM AND METHOD

CROSS-REFERENCE TO RELATED APPLICATION

This application claims priority to and the benefit of U.S. Provisional Application No. 63/486,119, entitled "ELECTRIC SUBMERSIBLE PUMP (ESP) SYSTEM AND METHOD," having a filing date of Feb. 21, 2023, the disclosure of which is incorporated herein by reference in its entirety.

FIELD OF THE INVENTION

The techniques described herein relate to the field of artificial lift technology for hydrocarbon wells. More particularly, the techniques described herein relate to electric submersible pumps (ESPs).

BACKGROUND

This section is intended to introduce various aspects of the art, which may be associated with embodiments of the present techniques. This discussion is believed to assist in providing a framework to facilitate a better understanding of particular aspects of the present techniques. Accordingly, it should be understood that this section should be read in this light, and not necessarily as admissions of prior art.

Artificial lift includes a number of methods for transporting produced hydrocarbon fluids within a wellbore to the surface when reservoir pressure alone is not sufficient. While many hydrocarbon wells initially have sufficient reservoir pressure to force hydrocarbon fluids from the reservoir to the surface, the reservoir pressure declines as production continues. As a result, more than 60% of hydrocarbon wells require the use of one or more artificial lift methods to boost production.

One common artificial lift method involves using electric submersible pump (ESP) systems to lift hydrocarbon fluids to the surface. More than 15% of hydrocarbon wells worldwide utilize some form of ESP system to aid with production. In fact, ESP systems are the fastest-growing form of artificial lift pumping technology. ESP systems are very versatile and are capable of operating in high-volume, high-depth environments. For example, a typical ESP system can handle flow rates in excess of 30,000 barrels per day (bpd) and can provide more than 15,000 feet of lift.

ESP systems typically have a large number of components and can be 100+ ft. in length. Typical ESP sections include an electric motor, a seal/protector, an intake, a gas separator (optional), centrifugal pumping stages, a discharge, and a downhole sensor (optional).

The ESP motor is typically a three-phase AC induction motor but can also be a permanent magnet motor. The motor is powered via a cable that extends to surface and through the wellhead. The motor spins a shaft which rotates the centrifugal pump stages, increasing the pressure of the pumped fluids so they can be produced to surface. The seal/protector section handles the thermal expansion of the motor's oil, allows the motor internals to equalize pressure with the well environment, and may carry a substantial portion of the ESP's thrust load.

ESP systems have relatively short run lives. Specifically, an average ESP system has a run life of two to three years, with a run life in excess of five years being uncommon. The run life of an ESP system is generally determined by the environment in which it operates, as well as by the manner in which it is operated. Moreover, because ESP systems are typically attached to production tubing and installed with a rig, ESP installation and replacement workovers can be relatively expensive. This is particularly true in offshore and remote locations, which often make ESP installations and retrievals economically prohibitive.

Rigless ESP System Installation

For these reasons, it may be desirable to install an ESP system without using a rig. In a rigless installation method, an assembled ESP system is "lubricated" into the well thru-tubing. In other words, the ESP system is deployed into the wellbore by inserting the ESP system through the production tubing without "killing" the well with heavy fluids. Such a deployment strategy may reduce the volume of potentially damaging kill fluids introduced to the producing formation during installation.

One type of commercially available rigless ESP installation system is known as a wet-mate system. The wet-mate technique employs a type of electrical connector known in the art as a wet-mate connector. The wet-mate connector allows an electrical connection to be made in an environment that is filled with fluid, such as in production tubing in a wellbore. This is why the connector is referred to as a "wet-mate" connector.

Wet-mate systems include an ESP power cable that is banded or clamped along the entire length of production tubing from the surface downhole to the ESP motor. The ESP power cable terminates at an electrical mandrel. The interior of the electrical mandrel contains a wet-mate receptacle. This receptacle accepts a plug that is attached to a thru-tubing ESP motor.

In a wet-mate installation, a thru-tubing ESP may be deployed either as a full ESP assembly or in multiple interlocking components. If the ESP system fails, it can be removed thru-tubing and replaced. If a component of the cable or electrical connectors fail, the entire production tubing must be pulled to replace it. This drives up ESP installation cost, particularly when an ESP is installed in a high-cost workover environment, such as offshore, arctic, subsea, or remote. The maximum ESP throughput/power of the wet-mate systems is only limited by the size of the tubing in which they are installed.

Another type of rigless system for deploying an ESP into a well is known as a cable-deployed system. Cable-deployed systems include full ESP assemblies that are installed thru-tubing with a combined power/deployment cable. The combined power/deployment cable typically has DC or AC electrical conductors and tensile members (such as braided line) to provide deployment/retrieval strength. One advantage of the cable-deployed system is that all of the components can be pulled from the well and replaced at a relatively low workover cost. These cable-deployed ESP systems are necessarily lower-power due to the tradeoffs of combining multiple engineering features into the power/deployment cable.

Using cable-deployed ESP systems, higher production volumes (e.g., greater than 1,000 barrels per day (BPD)) can be achieved at shallow depths, while the ESP system may be limited to lower volumes (a few hundred BPD) at deeper depths. The combined power/deployment cable must be able to support the full ESP assembly, and the ESP generally must be short enough for lubrication into a well (typically less than about 100 ft.). These factors as well as the tubing size limit the capabilities of the cable-deployed systems.

Although the wet-mate and cable-deployed systems have application niches, neither are suitable for areas with lower wellwork costs (such as onshore land operations) with higher-production, deeper reservoirs. The wet-mate systems are expensive because of the required reliability of the electrical connections, while the cable-deployed systems are depth/power/rate-limited. There exists a need for reliable techniques for installing and removing ESP systems.

SUMMARY

An embodiment described herein provides an electric submersible pump (ESP) system. The ESP system includes a pump and a motor connected to drive the pump. The pump and motor are disposed to pump fluid into production tubing in a wellbore. The ESP system further includes a connector in fluid communication with the production tubing. The connector contains a receptacle to receive a plug. A fixed power cable section is connected at a first end to power the motor. The fixed power cable section is fixedly connected at a second end to the receptacle of the connector. An ESP power cable extends through the production tubing to an ESP surface unit. The ESP power cable includes a removable plug to engage the receptacle of the connector.

Another embodiment described herein provides method of deploying an electric submersible pump (ESP) system in a hydrocarbon producing well. The method includes disposing a motor and a pump into production tubing in a wellbore. The motor is connected to drive the pump to pump fluid into the production tubing. A connector is in fluid communication with the production tubing and the connector contains a receptacle to receive a plug. A fixed power cable section is connected at a first end to power the motor. The fixed power cable section is fixedly connected at a second end to the receptacle of the connector. After the motor and the pump are disposed in the production tubing, an ESP power cable is extended through the production tubing. A removable plug of the ESP power cable is connected to engage the receptacle of the connector.

Still another embodiment described herein provides a hydrocarbon well that includes an electric submersible pump (ESP) system. The ESP system has a pump and a motor connected to drive the pump. Production tubing is disposed to receive fluid from the pump. A connector in fluid communication with the production tubing contains a receptacle to receive a plug. A fixed power cable section is connected at a first end to power the motor. The fixed power cable section is fixedly connected at a second end to the receptacle of the connector. An ESP power cable extends through the production tubing to an ESP surface unit. The ESP power cable includes a removable plug to engage the receptacle of the connector.

A still further embodiment described herein provides an electrical kick-over tool (EKOT), for making an electrical connection. The EKOT includes a connecting structure to orient a plug of a cable for connection into a receptacle. The EKOT is mechanically connected to an end of the cable having the plug.

These and other features and attributes of the disclosed embodiments of the present techniques and their advantageous applications and/or uses will be apparent from the detailed description that follows.

BRIEF DESCRIPTION OF THE DRAWINGS

The foregoing and other advantages of the present techniques may become apparent upon reviewing the following detailed description and drawings of non-limiting examples in which.

Figure 1:
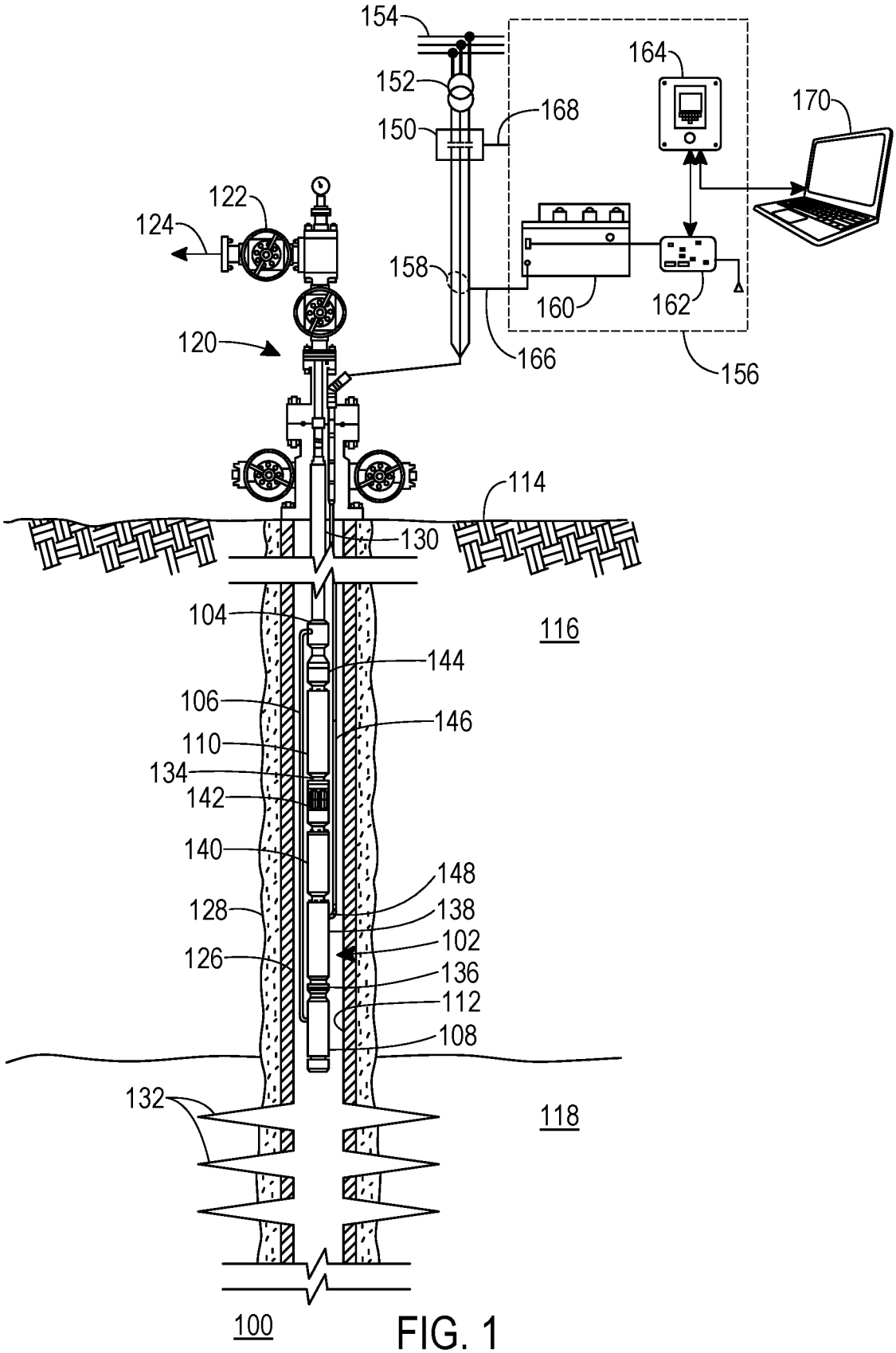
FIG. 1 [PRIOR ART]
FIG. 1 is a cross-sectional schematic view of a hydrocarbon well including an electric submersible pump (ESP) system.

It should be noted that the figures are merely examples of the present techniques, and no limitations on the scope of the present techniques are intended thereby. Further, the figures are generally not drawn to scale, but are drafted for purposes of convenience and clarity in illustrating various aspects of the techniques.

DETAILED DESCRIPTION

In the following detailed description section, the specific examples of the present techniques are described in connection with preferred embodiments. However, to the extent that the following description is specific to a particular embodiment or a particular use of the present techniques, this is intended to be for example purposes only and simply provides a description of the embodiments. Accordingly, the techniques are not limited to the specific embodiments described below, but rather, include all alternatives, modifications, and equivalents falling within the true spirit and scope of the appended claims.

At the outset, and for ease of reference, certain terms used in this application and their meanings as used in this context are set forth. To the extent a term used herein is not defined below, it should be given the broadest definition persons in the pertinent art have given that term as reflected in at least one printed publication or issued patent. Further, the present techniques are not limited by the usage of the terms shown below, as all equivalents, synonyms, new developments, and terms or techniques that serve the same or a similar purpose are considered to be within the scope of the present claims.

As used herein, the terms "a" and "an" mean one or more when applied to any embodiment described herein. The use of "a" and "an" does not limit the meaning to a single feature unless such a limit is specifically stated.

The term "and/of" placed between a first entity and a second entity means one of (1) the first entity, (2) the second entity, and (3) the first entity and the second entity. Multiple entities listed with "and/or" should be construed in the same manner, i.e., "one or more" of the entities so conjoined. Other entities may optionally be present other than the entities specifically identified by the "and/or" clause, whether related or unrelated to those entities specifically identified. Thus, as a non-limiting example, a reference to "A and/or B," when used in conjunction with open-ended language such as "including," may refer, in one embodiment, to A only (optionally including entities other than B); in another embodiment, to B only (optionally including entities other than A); in yet another embodiment, to both A and B (optionally including other entities). These entities may refer to elements, actions, structures, steps, operations, values, and the like.

The phrase "at least one," in reference to a list of one or more entities, should be understood to mean at least one entity selected from any one or more of the entities in the list of entities, but not necessarily including at least one of each and every entity specifically listed within the list of entities, and not excluding any combinations of entities in the list of entities. This definition also allows that entities may optionally be present other than the entities specifically identified within the list of entities to which the phrase "at least one" refers, whether related or unrelated to those entities specifically identified. Thus, as a non-limiting example, "at least one of A and B" (or, equivalently, "at least one of A or B," or, equivalently, "at least one of A and/or B") may refer, in one embodiment, to at least one, optionally including more than one, A, with no B present (and optionally including entities other than B); in another embodiment, to at least one, optionally including more than one, B, with no A present (and optionally including entities other than A); in yet another embodiment, to at least one, optionally including more than one, A, and at least one, optionally including more than one, B (and optionally including other entities). In other words, the phrases "at least one," "one or more," and "and/or" are open-ended expressions that are both conjunctive and disjunctive in operation. For example, each of the expressions "at least one of A, B, and C," "at least one of A, B, or C," "one or more of A, B, and C," "one or more of A, B, or C," and "A, B, and/or C" may mean A alone, B alone, C alone, A and B together, A and C together, B and C together, A, B, and C together, and optionally any of the above in combination with at least one other entity.

As used herein, the term "configured" mean that the element, component, or other subject matter is designed and/or intended to perform a given function. Thus, the use of the term "configured" should not be construed to mean that a given element, component, or other subject matter is simply "capable of" performing a given function but that the element, component, and/or other subject matter is specifically selected, created, implemented, utilized, and/or designed for the purpose of performing the function.

As used herein, the terms "example," exemplary," and "embodiment," when used with reference to one or more components, features, structures, or methods according to the present techniques, are intended to convey that the described component, feature, structure, or method is an illustrative, non-exclusive example of components, features, structures, or methods according to the present techniques. Thus, the described component, feature, structure or method is not intended to be limiting, required, or exclusive/exhaustive; and other components, features, structures, or methods, including structurally and/or functionally similar and/or equivalent components, features, structures, or methods, are also within the scope of the present techniques.

As used herein, the term "fluid" refers to gases, liquids, and combinations of gases and liquids, as well as to combinations of gases and solids, and combinations of liquids and solids.

"Formation" refers to a subsurface region including an aggregation of subsurface sedimentary, metamorphic and/or igneous matter, whether consolidated or unconsolidated, and other subsurface matter, whether in a solid, semi-solid, liquid and/or gaseous state, related to the geological development of the subsurface region. A formation can be a body of geologic strata of predominantly one type of rock or a combination of types of rock, or a fraction of strata having substantially common sets of characteristics. A formation can contain one or more hydrocarbon-bearing subterranean formations. Note that the terms "formation," "reservoir," and "interval" may be used interchangeably, but may generally be used to denote progressively smaller subsurface regions, zones, or volumes. More specifically, a "formation" may generally be the largest subsurface region, while a "reservoir" may generally be a hydrocarbon-bearing zone or interval within the geologic formation that includes a relatively high percentage of oil and gas. Moreover, an "interval" may generally be a sub-region or portion of a reservoir. In some cases, a hydrocarbon-bearing zone, or reservoir, may be separated from other hydrocarbon-bearing zones by zones of lower permeability, such as mudstones, shales, or shale-like (i.e., highly-compacted) sands.

A "hydrocarbon" is an organic compound that primarily includes the elements hydrogen and carbon, although nitrogen, sulfur, oxygen, metals, or any number of other elements may be present in small amounts. As used herein, the term "hydrocarbon" generally refers to components found in natural gas, oil, or chemical processing facilities. Moreover, the term "hydrocarbon" may refer to components found in raw natural gas, such as $CH_4$, $C_2H_6$, $C_3$ isomers, $C_4$ isomers, benzene, and the like.

The term "pressure" refers to a force acting on a unit area. Pressure is usually shown as pounds per square inch (psi).

As used herein, the term "production tubing" refers to a wellbore tubular that is connected to an electric submersible pump (ESP) discharge and is used to produce hydrocarbon fluids from a reservoir.

As used herein, the term "surface" refers to the uppermost land surface of a land well, or the mud line of an offshore well, while the term "subsurface" (or "subterranean") generally refers to a geologic strata occurring below the earth's surface. Moreover, as used herein, "surface" and "subsurface" are relative terms. The fact that a particular piece of equipment is described as being on the surface does not necessarily mean it must be physically above the surface of the earth but, rather, describes only the relative placement of the surface and subsurface pieces of equipment. In that sense, the term "surface" may generally refer to any equipment that is located above the casing, production tubing, and other equipment that is located inside the wellbore. Moreover, according to embodiments described herein, the terms "downhole" and "subsurface" are sometimes used interchangeably, although the term "downhole" is generally used to refer specifically to the inside of the wellbore.

The term "wellbore" refers to a hole drilled vertically, at least in part, and may also refer to a hole drilled with deviated, highly deviated, and/or horizontal sections. The term "hydrocarbon well" includes the wellbore as well as the associated equipment, such as the wellhead, casing string(s), production tubing, and the like.

Overview

Embodiments described herein provide an electric submersible pump (ESP) system. An ESP system according to the present techniques may provide improved component reliability relative to known wet-mate and cable-deployed ESP systems, as explained herein.

FIG. 1 is a cross-sectional schematic view of a hydrocarbon well 100 including an electric submersible pump (ESP) system 102 with a discharge pressure sensor 104 and a hydraulic line 106 that enable a monitoring unit 108 to measure the discharge pressure of a pump 110. The hydrocarbon well 100 defines a wellbore 112 that extends from a surface 114 into a formation 116 within the earth's subsurface. The formation 116 may include several subsurface intervals, such as a hydrocarbon-bearing interval that is referred to herein as a reservoir 118.

The hydrocarbon well 100 also includes a wellhead 120. The wellhead 120 includes a number of pipes, valves, gauges, and other instrumentation for controlling the hydrocarbon well 100. For example, the wellhead 120 includes a wing valve 122 that controls the flow of hydrocarbon fluids from the wellbore 112, as indicated by arrow 124.

The hydrocarbon well 100 is completed by setting a series of tubulars, referred to as casing strings, into the formation 116. The simplified schematic of FIG. 1 depicts a hydrocarbon well 100 with a single casing string, which is referred to as the production casing string 126. However, it will be appreciated by one of skill in the art that the hydrocarbon well 100 may often include a number of different casing strings, such as a surface casing string, one or more intermediate casing strings, and the production casing string 126. Moreover, each casing string may be either hung from the surface 114 or from the bottom of the previous casing string using a liner hanger. As shown in FIG. 1, the production casing string 126 (as well as any surface and intermediate casing strings) is set in place using cement 128. The cement 128 isolates the intervals of the formation 116 from the hydrocarbon well 100 and each other. Alternatively, in some embodiments, the hydrocarbon well 100 may be set as an open-hole completion, meaning that the production casing string 126 is not set in place using cement.

The hydrocarbon well 100 includes production tubing 130 extending through the production casing string 126. In addition, the portion of the production casing string 126 extending into the reservoir 118 includes a number of perforations 132 that allow hydrocarbon fluids within the reservoir 118 to flow into the hydrocarbon well 100 and up the production tubing 130 to the surface 114. While the embodiment shown in FIG. 1 includes only one set of perforations 132, it will be appreciated by one of skill in the art that the hydrocarbon well 100 may include many separate stages extending through the reservoir 118, where each stage includes several sets of perforations. Moreover, while the simplified schematic view of FIG. 1 depicts the hydrocarbon well 100 as a vertical well, it will be appreciated by one of skill in the art that the hydrocarbon well 100 may include one or more lateral or deviated sections extending through the reservoir 118.

In many cases, the pressure within the reservoir 118 is initially high enough to force hydrocarbon fluids to the surface 114 without any assistance. However, as production continues, the reservoir pressure declines, causing the flow rate of the hydrocarbon fluids to decrease. Therefore, according to embodiments described herein, the hydrocarbon well 100 includes the electric submersible pump (ESP) system 102. The ESP system 102 provides artificial lift capabilities, boosting produced hydrocarbon fluids to the surface 114 when reservoir pressure alone is not sufficient. According to the embodiment shown in FIG. 1, the ESP system 102 is attached to, and installed with, the production tubing 130. However, in other embodiments, the ESP system 102 may be installed in any other suitable manner, such as via coiled tubing, for example.

In various embodiments, the ESP system 102 includes a number of components that are attached to a shaft 134. Specifically, the ESP system 102 includes the monitoring unit 108, a motor base crossover 136, a motor 138, a protector (or seal unit) 140, a pump intake 142, the pump 110, and a pump discharge 144. In operation, the produced hydrocarbon fluids enter the pump 110 via the pump intake 142. Because ESP systems have lower efficiencies in high gas/oil ratio (GOR) scenarios, the pump intake 142 may include a gas separator for removing free gas from the hydrocarbon fluids before the hydrocarbon fluids enter the pump 110. In some embodiments, the gas separator is a rotary gas separator that uses centrifugal force to separate the free gas from the liquids within the hydrocarbon fluids.

In various embodiments, the pump 110 is a multi-stage, centrifugal pump, where each stage within the pump 110 includes a rotating impeller and a stationary diffuser that sequentially increases the velocity and pressure of the hydrocarbon fluids flowing through the pump 110. In operation, the motor 138 spins the shaft 134, which rotates the impeller within each stage. This, in turn, increases the pressure of the pumped hydrocarbon fluids so that the hydrocarbon fluids can be produced to the surface 114. Because ESP systems are typically designed to fit in casing strings with limited inner diameters, the lift provided by each stage is relatively low. Therefore, many stages are stacked together within the pump housing to provide the desired amount of lift for the particular application.

In some embodiments, the motor 138 is a three-phase, squirrel-cage AC induction motor. In other embodiments, the motor 138 is a permanent magnet motor. The motor 138 is designed to work in high-temperature, high-pressure environments. The motor 138 may be filled with oil that provides dielectric strength and bearing lubrication, as well as a thermal pathway for dissipating heat generated by the motor windings.

The motor 138 is powered by an ESP power cable 146 that is connected to the motor 138 via a power cable connector 148, which may be referred to as a "pothead connector." The ESP power cable 146 is securely fixed to production tubing 130. The ESP power cable 146 extends through the wellbore 112 and through the wellhead 120 at the surface 114. In various embodiments, the ESP power cable 146 is an armored, three-phase electrical power cable, as described further herein. The ESP power cable 146 is connected to a switchboard or variable speed drive (VSD) 150, a transformer 152, and an electrical supply system 154, such as a commercial power distribution system, located at the surface 114.

The protector 140, which is also referred to as the "seal section" of the ESP system 102 protects the motor 138 from contamination by wellbore fluids. In addition, the protector 140 equalizes the pressure between the motor 138 and the wellbore 112, absorbs a substantial portion of the thrust load from the pump 110, and handles the thermal expansion of the oil within the motor 138.

The monitoring unit 108 is connected to the motor 138 via the motor base crossover 136. Specifically, the monitoring unit 108 is electrically connected to the motor wye point within the motor base crossover 136, which carries a secondary AC power signal to the monitoring unit 108. In various embodiments, the monitoring unit 108 includes DC power conversion circuitry that is configured to convert the AC power signal into a DC power signal that is suitable for powering the components of the monitoring unit 108. In this manner, the monitoring unit 108 is powered by a slipstream of the electricity that is being delivered to the motor 138 via the ESP power cable 146.

The monitoring unit 108 is configured to measure key parameters relating to the motor 138 and the pump intake 142, such as, for example, downhole vibration, motor oil temperature, motor winding temperature, intake pressure, intake temperature, water ingress, current leakage, wye voltage, and the like. These measurements are then communicated to an ESP surface unit 156 via the ESP power cable 146. Specifically, as indicated by dotted line 158, the sensor data are transmitted as a modulated signal that represents a serial digital data stream. In various embodiments, the modulated signal is generated by modulation circuitry, in cooperation with a microprocessor, within the monitoring unit 108. The modulated signal is then supplied to the motor wye point and is communicated over the conductors of the ESP power cable 146.

In various embodiments, the ESP surface unit 156 includes a surface choke 160, an ESP interface board 162, and a surface interface panel 164. As indicated by line 166, the surface choke 160 is used to isolate the motor voltage from the modulated signal before the modulated signal is received and interpreted by the ESP interface board 162. Specifically, the surface choke 160 includes demodulation circuitry that recovers the digital data stream from the modulated signal and supplies the recovered digital data stream to the ESP interface board 162. The ESP interface board 162 then interprets the digital data stream and (optionally) provides feedback relating to the data stream to the VSD 150, as indicated by dotted line 168. The VSD 150 may then use the feedback to determine the proper flow of electricity to the motor 138. In some embodiments, the interpreted data stream is also output to a surface interface panel 164, and then to the ESP operator via one or more remote devices, such as the laptop computer 170 shown in FIG. 1.

The ESP operator then uses the information provided by these measurements for ESP surveillance, troubleshooting, and optimization. For example, the ESP operator may use the information to proactively intervene when the performance of the ESP system is gradually declining. In this manner, such information can be used to extend the run life of the ESP system, as well as boost production from the hydrocarbon well. In addition, in some cases, such information can provide helpful insight into the characteristics of the reservoir, which may be used to further improve production.

In some embodiments, the ESP operator may intervene by adjusting the frequency of the motor 138 or adjusting the voltage transmitted to the motor 138. Moreover, in some embodiments, the VSD 150 is configured to automatically adjust the frequency and/or voltage of the motor 138, or automatically shut down the motor 138, in response to receiving certain feedback from the ESP interface board 162. For example, if the feedback indicates that the value of a particular parameter exceeds a specific threshold, an electrical switch within the VSD 150 may automatically trip, shutting down the motor 138.

Figure 2:
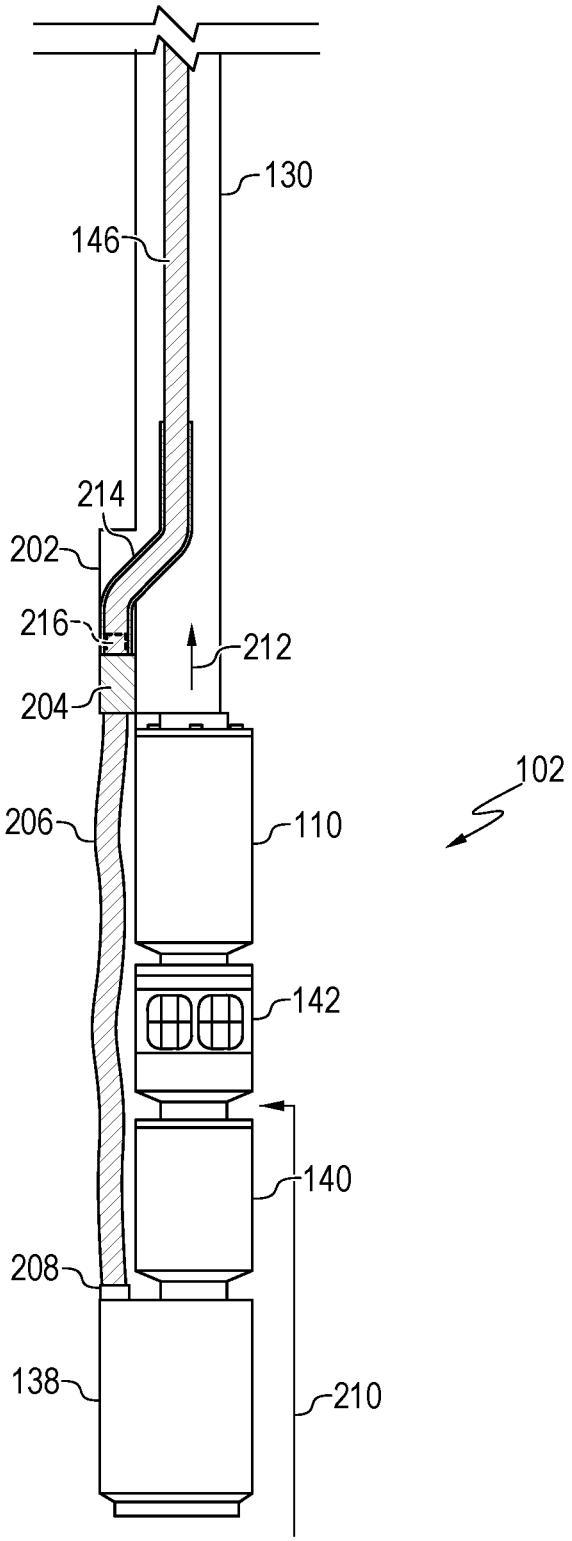
FIG. 2 is a schematic view of an ESP system showing an exemplary embodiment of a connector and cable arrangement for a tubing-deployed installation according to the present techniques.

FIG. 2 is a schematic view of an ESP system showing an exemplary embodiment of a connector and cable arrangement for a tubing-deployed installation according to the present techniques. FIG. 2 is generally referred to by the reference number 200. As will be explained herein, the present techniques provide an ESP system 102 having reduced dependency on a permanently fixed power cable. This improves the failure rate of ESP systems of the present techniques.

FIG. 2 shows an ESP system 102 that is mounted onto the end of production tubing 130. However, the ESP power cable 146 is not necessarily permanently affixed to the production tubing 130. Flow into and through the ESP system 102 is indicated by arrows 210 and 212, respectively.

In the exemplary embodiment of the present techniques shown in FIG. 2, a wet-mate connector system of the tubing deployed ESP system 102 may include a permanent completion that is a component of the production tubing 130. The permanent completion components may be built into and deployed, along with the ESP system 102, at the initial installation of the production tubing 130. The permanent completion includes a fixed power cable section 206, which is banded or clamped to the ESP system 102. The fixed power cable section 206 may be flat to take up less space when next to the motor 138. The fixed power cable section 206 is generally known as a motor lead extension (MLE). MLE cables may have more rugged construction than typical cables.

The fixed power cable section 206 terminates on one end at an electrical side-pocket mandrel 202 located above the output of the pump 110. The electrical side-pocket mandrel 202 is in fluid communication with the production tubing 130. The interior of the first electrical side-pocket mandrel 202 contains a wet-mate receptacle 204. The wet-mate receptacle 204 may accept a connector plug to complete a connection. Moreover, the electrical connection made in the wet-mate receptacle 204 may be done in any suitable manner known to those of skill in the art using any sort of electrical connecting components. In an exemplary embodiment of the present techniques, the connection of the ESP power cable 146 to the wet-mate receptacle 204 is testable both electrically and via pressure.

With regard to pressure testing, when the ESP power cable 146 is connected to the wet-mate receptacle 204, pressure may be applied from surface to simulate discharge pressure from the pump 110. This pressure could be measured with the discharge pressure sensor 104, if available. Otherwise, the pressure could be applied, and electrical tests could be performed on the ESP power cable 146 from the surface 114. The goal is to prove that the connection of the ESP power cable 146 is electrically secure while external pressure is applied.

The distal end of the fixed power cable section 206 is connected to the motor 138. The connection to the motor 138 may be made via a fixed connector 208. The electrical side-pocket mandrel 202, and the fixed power cable section 206 comprise the permanent completion aspect of the tubing-deployed ESP system 102 shown in FIG. 2.

Once the production tubing 130 is in place, including the tubing deployed ESP system 102, the ESP power cable 146 may be run into the production tubing 130 and plugged into the electrical side-pocket mandrel 202 using an integral electrical kick-over tool (EKOT) 214.

In an exemplary embodiment, the EKOT 214 is a mechanical device that works to guide or force a plug into place in a receptacle to make an electrical connection. The EKOT 214 includes a connecting structure 216 that orients a plug in the connector 204 to connect to a receptacle in the electrical side-pocket mandrel 202. The connecting structure 216 may include tabs, grooves, or any other suitable means to orient the plug of the ESP power cable 146 to be inserted in the receptacle of the connector 204. In an exemplary embodiment, the EKOT 214 could be mechanically attached to the ESP power cable 146 and may stay in the well with the ESP power cable 146 when the ESP power cable 146 is deployed as described herein. Alternatively, the EKOT 214 may be fixedly connected to the electrical side-pocket mandrel 202 to receive the ESP power cable 146 when it is deployed.

In operation, the EKOT 214 could be run into the well in a straight orientation. The EKOT 214 may include one or more joints that could be forced into the proper angles by a profile or profiles that are integral to the electrical side-pocket mandrel 202. Moreover, the joint or joints of the EKOT may dispose the EKOT 214 in a proper attitude for insertion of the plug of the ESP power cable 146 in the receptacle of the wet-mate connector 204. The EKOT 214 thus orients a plug or connector at the end of the ESP power cable 146 to connect to a receptacle of the wet-mate connector 204 in the electrical side-pocket mandrel 202.

The electrical side pocket mandrel 202 may include a mechanical alignment structure or section above the wet-mate connector 204 to assist in the operation of the EKOT 214. The orienting profile in the alignment structure of the electrical side-pocket mandrel 202 would be integral to the inner diameter of the production tubing 130, so full-drift devices could run through it without issue. Alternatively, the EKOT 214 could be run down past the electrical side pocket mandrel 202, potentially tagging the discharge of the pump 110. The EKOT 214 could then be pulled up to the alignment structure of the electrical side-pocket mandrel 202, which would rotate the EKOT 214 and the ESP power cable 146 to align with the wet-mate connector 204.

If the electrical side-pocket mandrel 202 is at a high angle relative to the ESP power cable 146, a tractor could be integrated into the ESP power cable 146 to transport the ESP power cable 146 to the installation depth. It may also be possible to pump the ESP power cable 146 and EKOT 214 to installation depth while displacing pumped fluids backward through the ESP pump 110 and out of the pump intake 142.

As an alternative to employing the connecting structure 216, the EKOT 214 could be oriented by sending power through the ESP power cable 146. A low-power signal could be used to inductively pull the ESP power cable 146 into the correct axial orientation with a motor and tensile members in a manner similar to a knee brace. The motor 138 could also rotate the EKOT 214 locally as needed and be used independently or in conjunction with the connecting structure 216 described herein.

The ESP power cable 146 could be optimized for power capacity over deployment strength since it would only need to support its own weight rather than the combined weight of the ESP power cable 146 and the entire tubing-deployed ESP system 102. The wellhead penetration of the ESP power cable 146 could be completed at surface, and the ESP power cable 146 could be connected to the ESP surface unit 156, completing the electrical connection. Pumped fluids would leave the pump discharge 144, flow around the thru-tubing ESP power cable 146 inside the production tubing, and transit to surface. If the ESP power cable 146 or integral EKOT 214 failed above the electrical side-pocket mandrel 202, the ESP power cable 146 and/or EKOT 214 could be pulled and replaced at relatively low cost. The production tubing 130 would need to be pulled if the other ESP system components failed.

Figure 3:
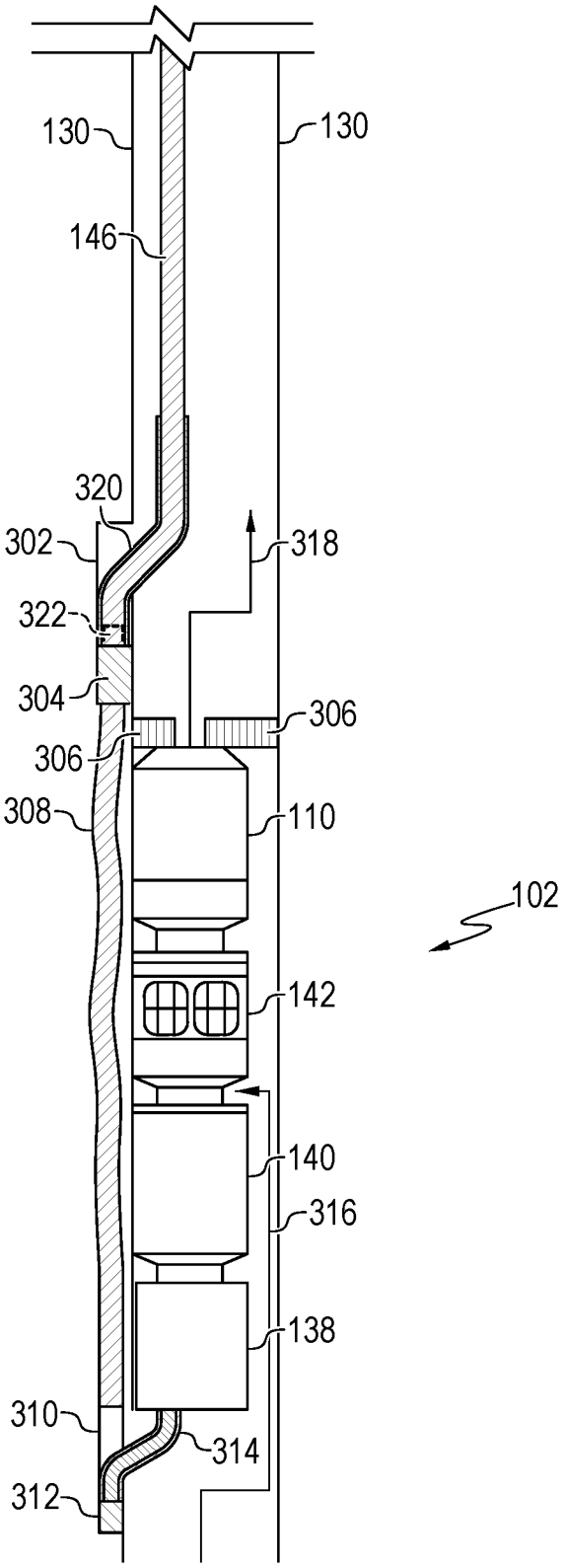
FIG. 3 is a schematic view of an ESP system showing an exemplary embodiment of a connector and cable arrangement for a thru-tubing installation according to the present techniques.

FIG. 3 is a schematic view of a thru-tubing ESP system 102 showing an exemplary embodiment of a connector and cable arrangement for a thru-tubing installation according to the present techniques. FIG. 3 is generally referred to by the reference number 300. Flow into and through the ESP system 102 is indicated by arrows 316 and 318, respectively.

In an exemplary embodiment of the present techniques shown in FIG. 3, a wet-mate connector system of the thru-tubing ESP system 102 may include a permanent completion that is a component of the production tubing 130. The permanent completion components may be built into and deployed at the initial installation of the production tubing 130. The permanent completion includes a fixed power cable section 308, which is banded/clamped to the production tubing 130. The fixed power cable section 308, which may be an MLE, may be flat to take up less space when next to the motor 138.

The fixed power cable section 308 terminates on one end at a first electrical side-pocket mandrel 302. The first electrical side-pocket mandrel 302 is in fluid communication with the production tubing 130. The interior of the first electrical side-pocket mandrel 302 contains a wet-mate receptacle 304. This receptacle accepts a plug attached to the ESP power cable 146.

The distal end of the fixed power cable section 308 terminates downhole at a second electrical side-pocket mandrel 310. The second electrical side-pocket mandrel 310 includes a fixed connector 312. The fixed connector functions to connect the fixed power cable section 308 to the motor 138 via a motor power cable 314. The two electrical side-pocket mandrels 302, 310, and the fixed power cable section 308 comprise the permanent completion aspect of the thru-tubing ESP system 102 shown in FIG. 3.

Once the production tubing 130 is in place, the thru-tubing ESP system 102 may be deployed either as a full ESP assembly or in multiple interlocking components. The pump 110, motor 138 and other components could be run in with slickline, braided line, coiled tubing, rods, or some other suitable deployment method, whether the system was multi-component interlocking or a single assembly. Once installed, the ESP system 102 is restrained from moving by a packoff 306.

The packoff 306 is a sealing element that separates the intake pressure from the discharge pressure. It also has some mechanical elements (dogs/slips) that hold the seal in place, typically by pressing against the inner diameter of the production tubing 130. The packoff 306 is similar to a retrievable packer.

The ESP power cable 146 may be engaged with the wet-mate connector 304 using an EKOT 320. The EKOT 320 includes a connecting structure 322. The connection process using the EKOT 320 would be similar to the connection process described above with respect to the EKOT 214 in FIG. 2. The thru-tubing ESP motor 138 may be plugged into the second electrical side-pocket mandrel 310 using an additional EKOT (not shown).

If the thru-tubing ESP system 102 fails, it can be removed thru-tubing and replaced. If a component in the permanent completion fails, the entire production tubing 130 must be pulled to replace it.

The cable termination and production flowpath of the thru-tubing ESP system 102 shown in FIG. 3 would be substantially the same as the tubing-deployed embodiment shown in FIG. 2. The illustrative embodiment shown in FIG. 3 would allow rigless replacement of all of the system components other than the two electrical side-pocket mandrels 302, 310 and the fixed power cable section 308, which could of be replaced by pulling the production tubing 130 if necessary.

In another embodiment of the present techniques, one or both of the electrical side-pocket mandrels 302, 310 could include an additional pocket designed for a gas lift valve that would be plugged with a dummy valve during ESP operation. Once ESP operations were completed and the ESP assembly and ESP power cable 146 is removed, the electrical side-pocket mandrels 302, 310 could then be converted to gas lift side-pocket mandrels using standard gas lift tools and techniques. The well could then be operated as a gas lift completion, assuming appropriate gas injection pressure and rate were available. The same dual-pocket electrical side-pocket mandrels could also be used for chemical injection valves with tubing-external chemical injection lines.

Figure 4:
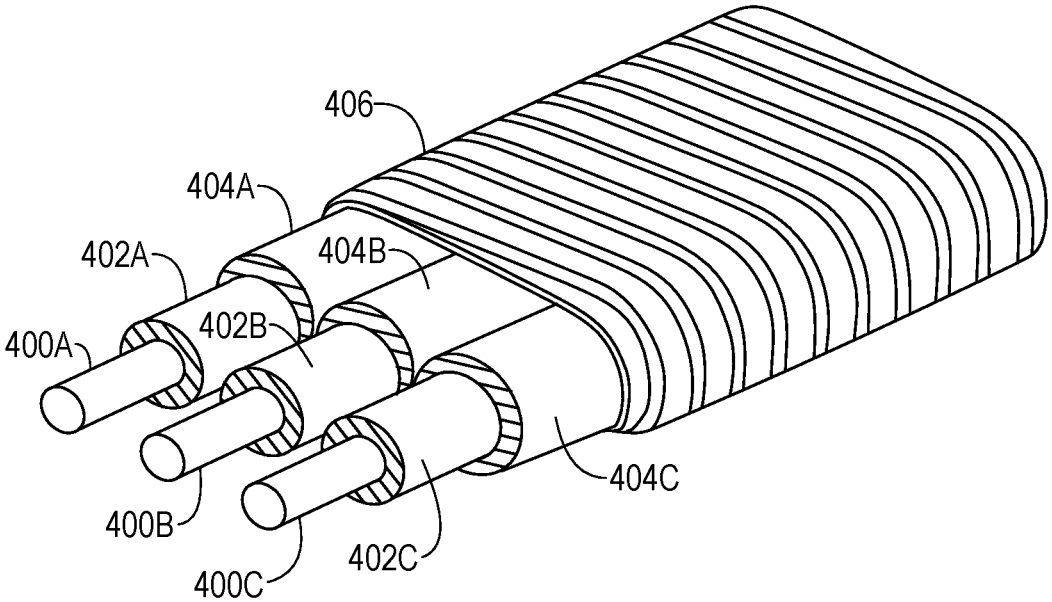
FIG. 4 is a perspective view of an exemplary embodiment of the ESP power cable described with respect to FIGS. 2-3.

FIG. 4 is a perspective view of an exemplary embodiment of the ESP power cable 146 described with respect to FIGS. 2-3. Like numbered items are as described with respect to FIGS. 1-3. As shown in FIG. 4, the ESP power cable 146 may be an electrical cable including three conductors 400A-C, which may be soft-drawn, tin-coated copper (SDTC) conductors, for example. Each conductor 400A-C is wrapped in insulation 402A-C, which may be high-dielectric thermoplastic insulation, for example, as well as an outer jacket 404A-C, which may be constructed from electrical-grade thermoplastic insulation, for example.

The size of the conductors 400A-C may be selected based on the motor current load, and the voltage rating of the insulation 402A-C may be selected based on the motor voltage.

In some embodiments, the ESP power cable 146 is a flat cable, as shown in FIG. 4. In many cases, flat cables are used for downhole applications due to the limited inner diameter of the casing. However, round cables may also be used, depending on the details of the specific implementation.

In some exemplary embodiments, the ESP power cable 146 could be round. A round ESP power cable 146 may be easier to seal when being lubricated into a wellbore 112.

The ESP power cable 146 also includes an armor 406. In some embodiments, the armor 406 is constructed of galvanized steel, which provides mechanical protection that allows the ESP power cable 146 to withstand high stress environments. Moreover, in various embodiments, the armor 406 is connected to earth and is used as the circuit protective conductor, or "earth wire," for the downhole equipment supplied by the ESP power cable 146. Furthermore, as described with respect to FIGS. 2 and 3, the armor 406 may also act as the conductive pathway for communicating sensor communications.

The perspective view of FIG. 4 is not intended to indicate that the ESP power cable 146 is to be constructed exactly as shown in FIG. 4. Rather, it will be appreciated by one of skill in the art that a wide range of cable sizes and construction types may be used. In general, several different factors, such as, for example, wellbore conditions, available space, and motor size, will be used to determine the most suitable cable type for each particular implementation.

In some embodiments, the ESP power cable 146 includes a fourth conductor (not shown) that acts as the ground path. In such embodiments, sensor communications may be sent from a discharge monitoring unit to a base monitoring unit via the fourth conductor, rather than the armor 406.

Figure 5:
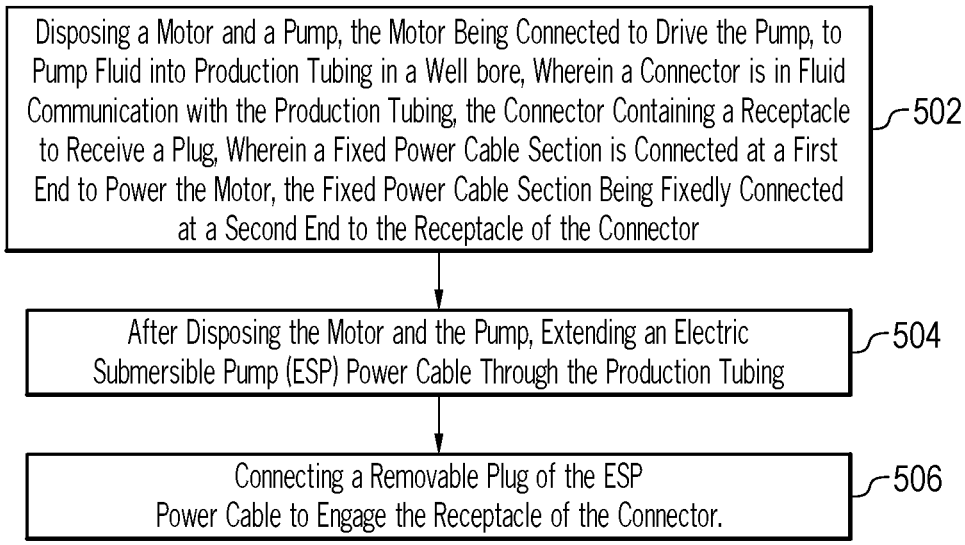
FIG. 5 is a process flow diagram of a method for deploying an ESP system in accordance with the present techniques.

FIG. 5 is a process flow diagram of a method for deploying an ESP system in accordance with the present techniques. The method shown in FIG. 5 is generally referred to by the reference number 500.

The method 500 begins at block 502, at which the motor 138 and the pump 110 are disposed to pump fluid into the production tubing 130 in the wellbore 112. Other components may be moved into the wellbore 112 as well. As described herein, the motor 138 is connected to drive the pump 110. The wet-mate receptacle 204 is in fluid communication with the production tubing 130. In an exemplary embodiment of the present techniques, the wet-mate receptacle 204 is disposed within the electrical side-pocket mandrel 202. The wet-mate receptacle 204 contains a receptacle to receive a plug. The fixed power cable section 206 is connected at a first end to power the motor 138. The fixed power cable section 206 is fixedly connected at a second end to the receptacle of the wet-mate receptacle 204.

The method 500 continues at block 504, with the ESP power cable 146 being extended through the production tubing 130 to be connected to the motor 138. The ESP power cable 146 is extended after the motor 138 and the pump 110 have been placed into the wellbore 112.

At block 506, a removable plug of the ESP power cable 146 is connected to engage the receptacle of the wet-mate receptacle 204 to provide power to the motor 138. This ends the method 500.

The process flow diagram of FIG. 5 is not intended to indicate that the steps of the method 500 are to be executed in any particular order, other than where indicated specifically, or that all of the steps of the method 500 are to be included in every case. Further, any number of additional steps not shown in FIG. 5 may be included within the method 500, depending on the details of the specific implementation.

In one or more embodiments, the present techniques may be susceptible to various modifications and alternative forms, such as the following embodiments as noted in paragraphs 1 to 29:

1. An electric submersible pump (ESP) system, comprising: a pump; a motor connected to drive the pump, the pump and motor being disposed to pump fluid into production tubing in a wellbore; a connector in fluid communication with the production tubing, the connector containing a receptacle to receive a plug; a fixed power cable section connected at a first end to power the motor, the fixed power cable section being fixedly connected at a second end to the receptacle of the connector; and an ESP power cable extending through the production tubing to an ESP surface unit, the ESP power cable including a removable plug to engage the receptacle of the connector.
2. The ESP system of paragraph 1, comprising: a second connector in fluid communication with the production tubing, the second connector being connected to the first end of the fixed power cable section, the second connector being disposed to receive a plug connected to the motor via a motor power cable.
3. The ESP system of paragraph 2, wherein the second connector is disposed in an electrical side-pocket mandrel in fluid communication with the production tubing.
4. The ESP system of paragraph 2, wherein the connector, the second connector and the fixed power cable section are fixedly attached to an outside surface of the production tubing.
5. The ESP system of any of paragraphs 1 to 4, wherein the connector is disposed in an electrical side-pocket mandrel that is in fluid communication with the production tubing.
6. The ESP system of paragraph 5, wherein the electrical side-pocket mandrel has a gas lift valve pocket that may be disabled during ESP operation.
7. The ESP system of any of paragraphs 1 to 6, wherein the pump and the motor are at least a portion of a component that is fixedly attached to an end of the production tubing.
8. The ESP system of any of paragraphs 1 to 7, wherein the pump and the motor are at least a portion of a component that is not fixedly attached to the production tubing but that is held in place within the production tubing by a packoff.
9. The ESP system of paragraph 8, wherein the ESP system is disposed inside of the production tubing.

10. The ESP system of any of paragraphs 1 to 9, wherein the removable plug of the ESP power cable is engaged with the connector using an electrical kick-over tool (EKOT).
11. A method of deploying an electric submersible pump (ESP) system in a hydrocarbon producing well, the method comprising: disposing a motor and a pump into a wellbore, the motor being connected to drive the pump, to pump fluid into production tubing in the wellbore, wherein a connector is in fluid communication with the production tubing, the connector containing a receptacle to receive a plug, wherein a fixed power cable section is connected at a first end to power the motor, the fixed power cable section being fixedly connected at a second end to the receptacle of the connector; after disposing the motor and the pump in the wellbore, extending an ESP power cable through the production tubing; and connecting a removable plug of the ESP power cable to engage the receptacle of the connector.
12. The method of paragraph 11, comprising: connecting a plug to a second connector, the second connector in fluid communication with the production tubing, the second connector being connected to the first end of the fixed power cable section, the plug being connected to the motor via a motor power cable.
13. The method of paragraph 12, wherein the second connector is disposed in an electrical side-pocket mandrel in fluid communication with the production tubing.
14. The method of paragraph 12, wherein the connector, the second connector and the fixed power cable section are fixedly attached to an outside surface of the production tubing.
15. The method of any of paragraphs 11 to 14, wherein the connector is disposed in an electrical side-pocket mandrel that is in fluid communication with the production tubing.
16. The method of any of paragraphs 11 to 15, wherein the pump and the motor are at least a portion of a component that is fixedly attached to an end of the production tubing.
17. The method of any of paragraphs 11 to 16, wherein the pump and the motor are at least a portion of a component that is not fixedly attached to the production tubing but that is held in place within the production tubing by a packoff.
18. The method of paragraph 17, wherein the ESP system is disposed inside of the production tubing.
19. The method of any of paragraphs 11 to 18, comprising engaging the removable plug of the ESP power cable with the connector using an electrical kick-over tool (EKOT).
20. A hydrocarbon well, comprising: an electric submersible pump (ESP) system, that includes a pump and a motor connected to drive the pump; production tubing disposed to receive fluid from the pump; a connector in fluid communication with the production tubing, the connector containing a receptacle to receive a plug; a fixed power cable section connected at a first end to power the motor, the fixed power cable section being fixedly connected at a second end to the receptacle of the connector; and an ESP power cable extending through the production tubing to an ESP surface unit, the ESP power cable including a removable plug to engage the receptacle of the connector.
21. The hydrocarbon well of paragraph 20, comprising: a second connector in fluid communication with the production tubing, the second connector being connected to the first end of the fixed power cable section, the second connector being disposed to receive a plug connected to the motor via a motor power cable.
22. The hydrocarbon well of paragraph 21, wherein the second connector is disposed in an electrical side-pocket mandrel in fluid communication with the production tubing.
23. The hydrocarbon well of paragraph 21, wherein the connector, the second connector and the fixed power cable section are fixedly attached to an outside surface of the production tubing.
24. The hydrocarbon well of any of paragraphs 20 to 23, wherein the connector is disposed in an electrical side-pocket mandrel that is in fluid communication with the production tubing.
25. The hydrocarbon well of paragraph 24, wherein the electrical side-pocket mandrel has a gas lift valve that may be disabled during ESP operation.
26. The hydrocarbon well of any of paragraphs 20 to 25, wherein the pump and the motor are at least a portion of a component that is fixedly attached to an end of the production tubing.
27. The hydrocarbon well of any of paragraphs 20 to 26, wherein the pump and the motor are at least a portion of a component that is not fixedly attached to the production tubing but that is held in place within the production tubing by a packoff.
28. The hydrocarbon well of paragraph 26, wherein the ESP system is disposed inside of the production tubing.
29. The hydrocarbon well of any of paragraphs 20 to 28, wherein the removable plug of the ESP power cable is engaged with the connector using an electrical kick-over tool (EKOT).
30. An electrical kick-over tool (EKOT), for making an electrical connection, the EKOT comprising: a connecting structure to orient a plug of a cable for connection into a receptacle, the EKOT being mechanically connected to an end of the cable having the plug.
31. The EKOT of paragraph 30, wherein the connecting structure includes tabs to engage the receptacle to orient the plug for insertion in the receptacle.
32. The EKOT of paragraphs 30 or 31, wherein the connecting structure includes grooves to engage the receptacle to orient the plug for insertion in the receptacle.
33. The EKOT of any of paragraphs 30 to 32, wherein the EKOT comprises one or more joints that dispose the EKOT in a proper attitude for insertion of the plug into the receptacle.
34. The EKOT of any of paragraphs 30 to 33, wherein the receptacle is disposed in an electrical side-pocket mandrel that is in fluid communication with production tubing in a hydrocarbon well.
35. The EKOT of paragraph 34, wherein the electrical side-pocket mandrel includes an alignment structure to engage with the connecting structure of the EKOT, the alignment structure rotating the EKOT and the cable to align the plug with the receptacle for insertion of the plug into the receptacle.
36. The EKOT of any of paragraphs 30 to 35, wherein the receptacle connects the cable to a fixed power cable section extending between the receptacle and a motor in a hydrocarbon well.
37. The EKOT of paragraph 36, wherein the cable extends through production tubing to an electrical submersible pump surface unit.

While the embodiments described herein are well-calculated to achieve the advantages set forth, it will be appreciated that the embodiments described herein are susceptible to modification, variation, and change without departing from the spirit thereof. Indeed, the present techniques include all alternatives, modifications, and equivalents falling within the true spirit and scope of the appended claims.

What is claimed is:

1. An electric submersible pump (ESP) system, comprising:

a pump;

a motor connected to drive the pump, the pump and motor being disposed to pump fluid into production tubing in a wellbore;

a first connector in fluid communication with the production tubing, the first connector containing a receptacle to receive a plug;

a fixed power cable section connected at a first end to power the motor, the fixed power cable section being fixedly connected at a second end to the receptacle of the connector; and an ESP power cable extending through the production tubing to an ESP surface unit, the ESP power cable including a removable plug to engage the receptacle of the first connector.

2. The ESP system of claim 1, comprising:

a second connector in fluid communication with the production tubing, the second connector being connected to the first end of the fixed power cable section, the second connector being disposed to receive a plug connected to the motor via a motor power cable.

3. The ESP system of claim 2, wherein the second connector is disposed in an electrical side-pocket mandrel in fluid communication with the production tubing.

4. The ESP system of claim 2, wherein the first connector, the second connector and the fixed power cable section are fixedly attached to an outside surface of the production tubing.

5. The ESP system of claim 1, wherein the first connector is disposed in an electrical side-pocket mandrel that is in fluid communication with the production tubing.

6. The ESP system of claim 5, wherein the electrical side-pocket mandrel has a gas lift valve pocket that may be disabled during ESP operation.

7. The ESP system of claim 1, wherein the pump and the motor are at least a portion of a component that is fixedly attached to an end of the production tubing.

8. The ESP system of claim 1, wherein the pump and the motor are at least a portion of a component that is not fixedly attached to the production tubing but that is held in place within the production tubing by a packoff.

9. The ESP system of claim 8, wherein the ESP system is disposed inside of the production tubing.

10. The ESP system of claim 1, wherein the removable plug of the ESP power cable is engaged with the connector using an electrical kick-over tool (EKOT) that is integral with the ESP power cable.

11. A method of deploying an electric submersible pump (ESP) system in a hydrocarbon producing well, the method comprising:

disposing a motor and a pump into a wellbore, the motor being connected to drive the pump, to pump fluid into production tubing in the wellbore, wherein a first connector is in fluid communication with the production tubing, the first connector containing a receptacle to receive a plug, wherein a fixed power cable section is connected at a first end to power the motor, the fixed power cable section being fixedly connected at a second end to the receptacle of the first connector;

after disposing the motor and the pump in the wellbore, extending an ESP power cable through the production tubing; and connecting a removable plug of the ESP power cable to engage the receptacle of the first connector.

12. The method of claim 11, comprising:

connecting a plug to a second connector, the second connector in fluid communication with the production tubing, the second connector being connected to the first end of the fixed power cable section, the plug being connected to the motor via a motor power cable.

13. The method of claim 12, wherein the second connector is disposed in an electrical side-pocket mandrel in fluid communication with the production tubing.

14. The method of claim 12, wherein the first connector, the second connector and the fixed power cable section are fixedly attached to an outside surface of the production tubing.

15. The method of claim 11, wherein the first connector is disposed in an electrical side-pocket mandrel that is in fluid communication with the production tubing.

16. The method of claim 11, wherein the pump and the motor are at least a portion of a component that is fixedly attached to an end of the production tubing.

17. The method of claim 11, wherein the pump and the motor are at least a portion of a component that is not fixedly attached to the production tubing but that is held in place within the production tubing by a packoff.

18. The method of claim 17, wherein the ESP system is disposed inside of the production tubing.

19. The method of claim 11, comprising engaging the removable plug of the ESP power cable with the first connector using an electrical kick-over tool (EKOT) that is integral with the ESP power cable.

20. A hydrocarbon well, comprising:

an electric submersible pump (ESP) system, that includes a pump and a motor connected to drive the pump;

production tubing disposed to receive fluid from the pump;

a first connector in fluid communication with the production tubing, the first connector containing a receptacle to receive a plug;

a fixed power cable section connected at a first end to power the motor, the fixed power cable section being fixedly connected at a second end to the receptacle of the first connector; and an ESP power cable extending through the production tubing to an ESP surface unit, the ESP power cable including a removable plug to engage the receptacle of the first connector.

21. The hydrocarbon well of claim 20, comprising:

a second connector in fluid communication with the production tubing, the second connector being connected to the first end of the fixed power cable section, the second connector being disposed to receive a plug connected to the motor via a motor power cable.

22. The hydrocarbon well of claim 21, wherein the second connector is disposed in an electrical side-pocket mandrel in fluid communication with the production tubing.

23. The hydrocarbon well of claim 21, wherein the first connector, the second connector and the fixed power cable section are fixedly attached to an outside surface of the production tubing.

* * * * *